United States Patent [19]

Markle

[11] 4,350,064

[45] Sep. 21, 1982

[54] AUXILIARY TOOL KIT FOR A SOCKET WRENCH SET

[76] Inventor: James R. Markle, 3410 Roberts, Kansas City, Mo. 64124

[21] Appl. No.: 217,664

[22] Filed: Dec. 18, 1980

[51] Int. Cl.[3] ..... B25B 21/00

[52] U.S. Cl. ..... 81/437; 81/459; 81/177 A

[58] Field of Search ..... 7/138; 81/177 A, 436, 81/437, 459, 441, 121 R, 53 R; 279/1 A; 408/226, 126, 241; 29/240

[56] References Cited

U.S. PATENT DOCUMENTS

| | | | |
|---|---|---|---|
| 921,840 | 5/1909 | Jacobs | 81/177 A |
| 1,775,402 | 9/1930 | Mandl | 81/177 A |
| 2,620,001 | 12/1952 | Fratz et al. . | |
| 2,637,232 | 5/1953 | McKean | 29/240 |
| 2,672,066 | 3/1954 | Sandrock et al. . | |
| 2,752,965 | 7/1956 | Mackey | 279/1 A |
| 3,023,015 | 2/1962 | Pankow | 81/437 |
| 3,227,015 | 1/1966 | Tremblay | 81/177 A |
| 3,312,260 | 4/1967 | MacNeill | 81/121 R |
| 3,333,490 | 8/1967 | Popin | 408/226 |
| 3,508,455 | 4/1970 | Miller . | |
| 3,802,302 | 4/1974 | Bengston | 81/177 A |
| 3,843,143 | 10/1974 | Laxson | 279/1 A |
| 4,004,476 | 1/1977 | DeVrou | 81/177 A |

*Primary Examiner*—Roscoe V. Parker

*Attorney, Agent, or Firm*—Litman, Day and McMahon

[57] ABSTRACT

An auxiliary tool kit for a socket wrench set is provided comprising an easy-out, an easily grippable extension with a rigid hand grip thereon, and an adapter extension for mating with an electric drill or alternatively, the kit is adapted for mating with a ratchet wrench.

7 Claims, 8 Drawing Figures

79
69
68
7
70
100
94
90
96
92
98
39
5
61
41
3
49
51
29
31
23
24
25
67
77
73
75
71
55
63
53
43
33
5.
7.

AUXILIARY TOOL KIT FOR A SOCKET WRENCH SET

BACKGROUND OF THE INVENTION

This invention relates to tool kits and in particular to tool kits for use with a socket wrench set.

Socket wrench sets comprising a handle and a selection of sockets and accessories are widely used in varying ways. In general, a ratchet or socket handle will be connected either directly or through the use of an accessory, such as a drive extension or a U-joint, to an associated socket which is adapted to engage a threaded fastener, such as a bolt or nut, and rotate same to either tighten or loosen the fastener.

Certain drawbacks exist in socket wrenches and accessories for socket wrenches. One such drawback is that the outside surface of a shank of an extension is usually polished or otherwise slick. Certain prior art has developed a pliable sleeve to place over the shank, but such sleeves tend to absorb grease and oil and not be effective in gripping the shank when substantial torque or leverage is needed to rotate the shank against worn or damaged threads of the fastener. This is particularly true when oil or grease contacts the surface of the shank. Because of this it is very difficult to exert any rotational impetus or torque to the extension and therefore socket through manual manipulation by a user. This is disadvantageous because it is sometimes more convenient to manipulate the associated socket manually in tightening or loosening the fastener particularly when little torque is required to rotate the socket. Further, in using a socket wrench to remove or engage an associated threaded fastener, the movement of the wrench handle itself is not continually producing the desired movement on the fastener thereby necessitating the use of more time to do the job. This is because for every rotation of the wrench there must be an associated counter rotation. Hence, use of the ratchet wrench in this manner is particularly cumbersome where the associated fastener must be rotated many times without great quantities of torque being applied thereto to either tighten or loosen the fastener such as with long shanked bolts.

Another drawback of socket wrench sets is that some useful tools have heretofore not been made adaptable to a socket wrench set such as easy-outs and drive extensions which are capable of mating with a rotary drill.

OBJECTS OF THE INVENTION

Therefore, the objects of this invention are: to provide an auxiliary tool kit for use with a ratchet or socket wrench; to provide such a kit which includes an extension drive which has therearound a rigid gripping surface which is fixedly secured thereto to allow the extension to be rotated manually; to provide an extension which is capable of mating with a socket at one end thereof and a chuck of a rotary drill at the other end thereof; to provide an easy-out which is capable of operably engaging a fastener that is desired to be removed from an associated object which easy-out is further adapted to engage an associated socket wrench; to provide such a kit which is especially adapted to remove broken bolts, screws or the like from a threaded aperture by utilization of a reversible power hand drill; and to provide such a kit which is simple in design, easy to manufacture, capable of extended use and particularly adapted for the intended usage thereof.

Other objects and advantages of this invention will become apparent from the following description taken in connection with the accompanying drawings wherein are set forth, by way of illustration and example, certain embodiments of this invention.

SUMMARY OF THE INVENTION

An auxiliary tool kit for a socket wrench set is provided. The tool kit includes an easy-out which at a first end thereof has threads which are reverse to standard threads and at a second end thereof has a female socket opening such as to be matable with an associated socket wrench drive mechanism. The kit further comprises an extension drive which has securely positioned around a shank thereof a generally rigid hand grip having longitudinal ridges and an increased manipulation radius as compared to the remainder of the shank such that a user thereof may provide rotational impetus to the extension due to improved gripping and leverage. Also included in the kit is an extension adapted to be mated with an associated socket at one end thereof and at the other end thereof adapted to be positioned and securely held within a chuck of a rotary drill so as to be rotatable thereby.

The kit is especially adapted to loosen a broken bolt or screw in a threaded aperture by utilization in conjunction with a power drill or alternatively, with a conventional ratchet wrench. After loosening, the broken bolt or screw can be further loosened and removed by manual rotation of the extension drive by manipulation of the grip thereof.

The drawings constitute a part of this specification and include exemplary embodiments of the present invention and illustrate various objects and features thereof.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
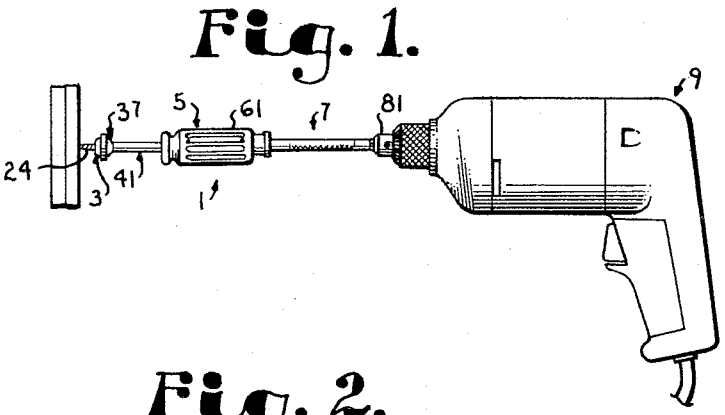
FIG. 1 is a perspective view of a tool kit embodying the present invention showing in particular, an easy-out, a grippable extension, and a drill adapter extension positioned on an electric power hand drill.
Figure 2:
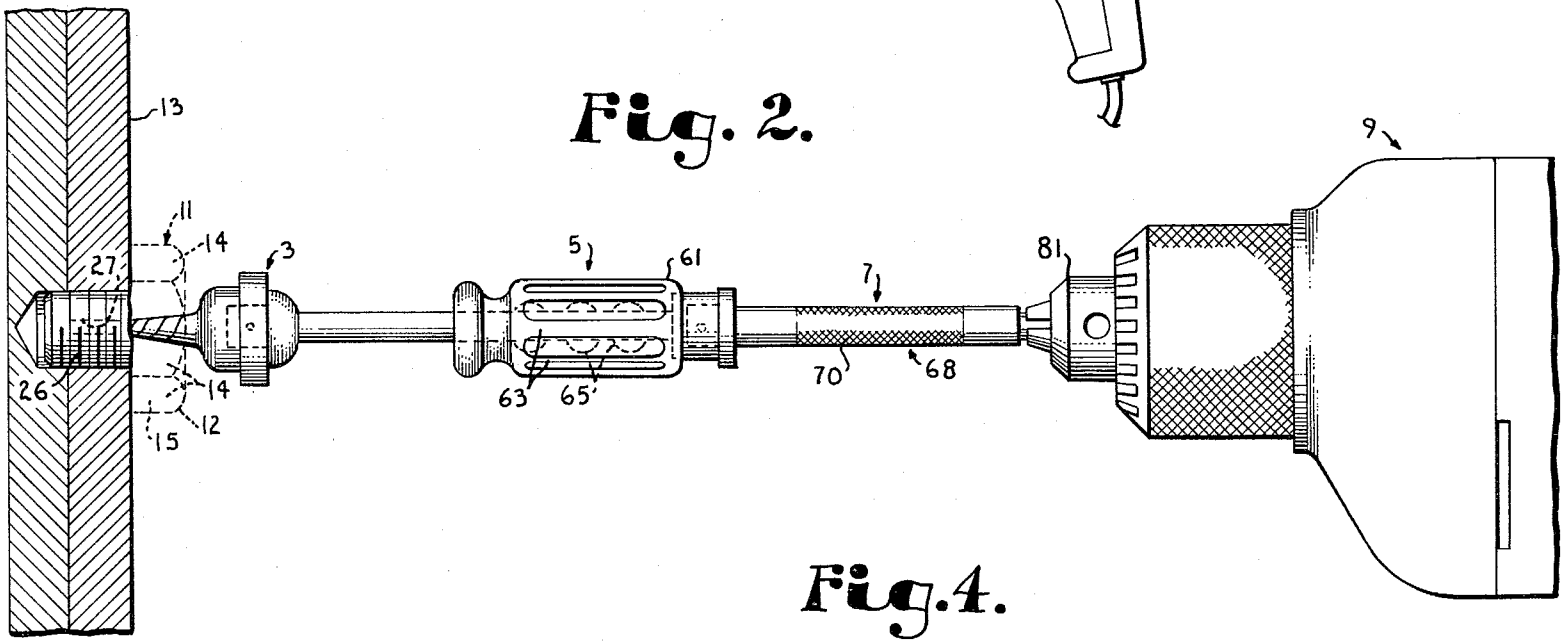
FIG. 2 is an enlarged view of the tool kit of FIG. 1 being utilized to remove a part of a bolt from a wall member.

The reference numeral 1 generally designates an auxiliary tool kit for a socket wrench set embodying the present invention. As shown in FIG. 1, the tool kit 1 comprises an easy-out 3, a grippable drive extension 5 and a drill adapter extension 7, which are adapted for being rotated by an associated rotary drill such as a reversible electric drill 9, as shown in FIG. 2, and/or a ratchet wrench, as shown in FIG. 8, to remove a threaded fastener 11, especially such a fastener with a broken or damaged portion, from an associated object 13.

Figures 3, 5, 6, 7, 8:
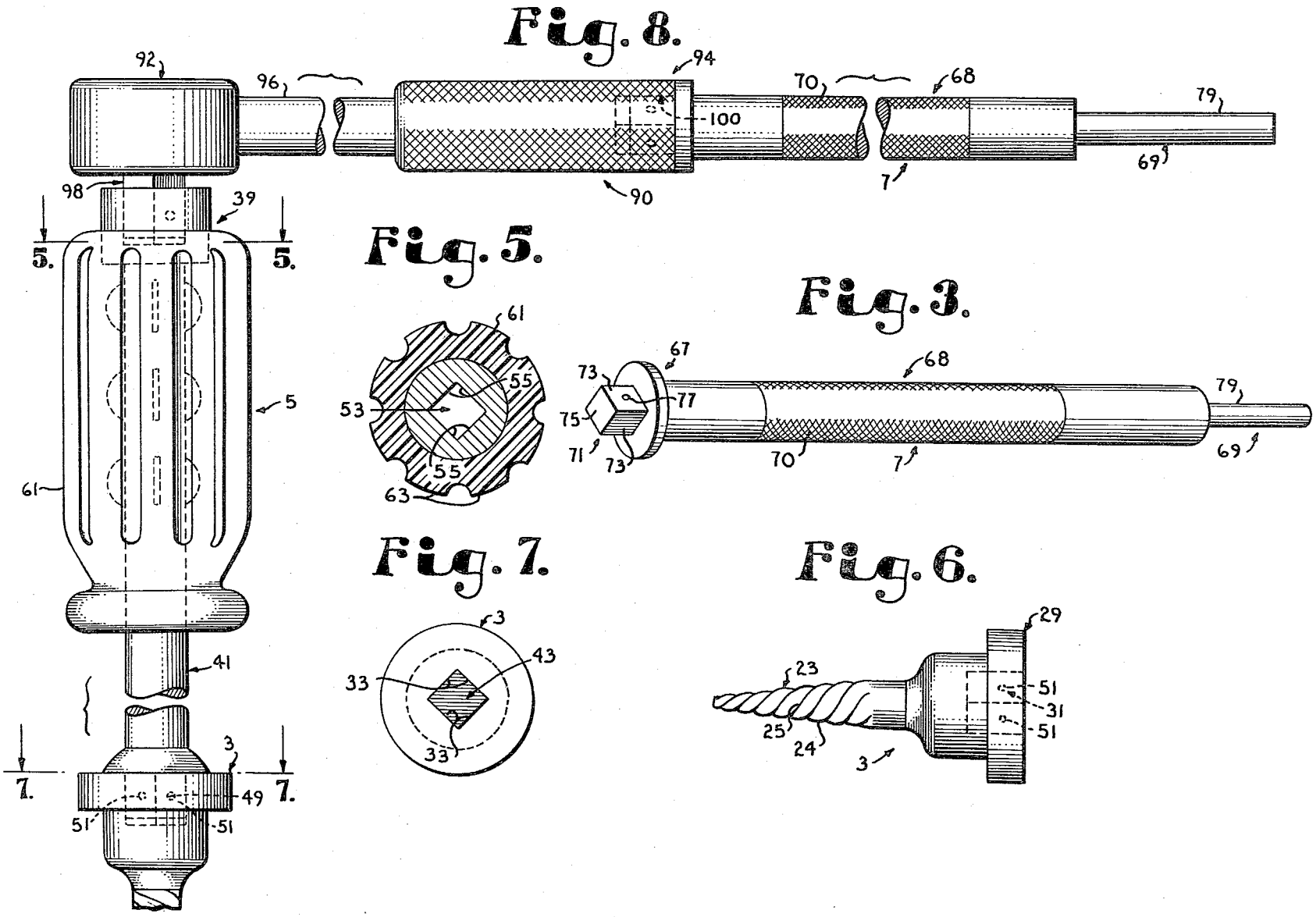
FIG. 3 is an enlarged perspective view of the drill adapted extension.
FIG. 5 is an enlarged cross-sectional view of the grippable extension taken along line 5—5 of FIG. 4.
FIG. 6 is an enlarged side elevational view of the easy-out.
FIG. 7 is an enlarged rear elevational view of the easy-out.
FIG. 8 is a perspective view of a tool embodying the present invention positioned on a socket wrench.

The easy-out 3, shown in FIGS. 6 and 7, is adapted to engage a predrilled opening or bore 27 in the fastener 11 which is shown here as a bolt 12 such that upon rotation of the easy-out in a generally counterclockwise direction or direction opposite that used to insert the bolt 12 into the object 13, the bolt 12 will be withdrawn from the object 13. This is desirable because in many instances fasteners such as bolts become stuck, broken, damaged or otherwise nonremovable by a conventional screwdriver, wrench or the like. A typical instance is when the surfaces of a bolt head 15 which comprise gripping surfaces 14 for an associated wrench (not shown) become rounded or otherwise nonfunctional through excessive or improper use or the head 15 of the bolt 12 may be entirely broken off by overtorquing, such as shown in FIG. 2. The easy-out 3 provides a means by which an otherwise nonremovable bolt or the like can be withdrawn from an associated object.

As shown, the easy-out 3 has a first end 23 which is tapered and includes a shank 24 which may have a variety of sizes having thereon threads 25. The threads 25 have a pitch which is reverse relative to threads 26 of the associated fastener 11.

At a second end 29 of the easy-out 3 there is a first socket drive member comprising an inwardly projecting female socket drive mechanism 31. The female drive mechanism or opening 31 comprises four walls or shoulders 33, each being of the same general dimensions such that the drive opening 31 is generally square. The drive opening 31 is adapted to mate with a conventional male socket drive mechanism.

Figure 4:
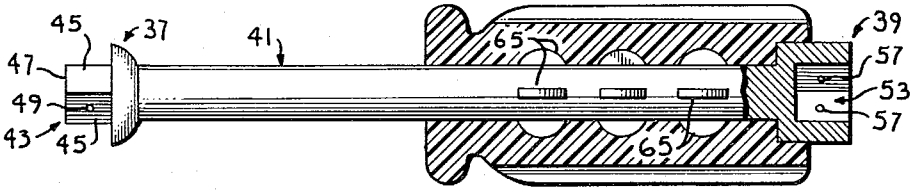
FIG. 4 is an enlarged side elevational view of the grippable extension with a portion broken away to show detail thereof.

The grippable drive extension 5, FIGS. 4 and 5, comprises a first end 37, a second end 39 and an intermediate shank portion 41. The first end 37 comprises a second socket drive member such as a male socket mechanism 43. The male socket drive mechanism 43 has four surfaces 45 and an end portion 47. The dimension of surfaces 45 is such that the end portion 47 generally comprises a square. The male socket drive mechanism 43 is adapted to operably engage and snugly retain thereon associated sockets or accessories (not shown). As shown in FIG. 1, the male socket drive mechanism 43 is also adapted to be matable with the easy-out female socket drive mechanism 31.

A detente ball 49 is positioned in a bore (not shown) in the male socket drive mechanism 43. The detente ball 49 is biased outwardly by means such as a spring (not shown) abutting against a shoulder of the bore (not shown) as is well known. When the male socket drive mechanism 43 mates with female socket mechanism 31 the detente ball 49 engages an associated hemispherical surface 51 formed in the female socket walls 33. This assures that the easy-out 3 will not inadvertently slip off of the grippable extension 5.

At the grippable extension second end 39 is a third socket drive member comprising a female socket drive mechanism 53 similar to the easy-out female socket mechanism 31 which includes walls 55 and an associated hemispherical surface 57. It is noted that instead of having a hemispherical surface such as 57 or 51 formed in the walls of the female socket opening 53, an inwardly projecting groove (not shown) could be formed around all wall surfaces so as to engage the detente ball 49.

The grippable extension shank 41 contains thereon a generally rigid hand grip 61 which is received around the shank 41. The hand grip 61 has ridges 63 which extend radially outward and longitudinally thereof and which are adapted to be gripped by a user thereof. The hand grip 61 is fixedly retained on shank 41 by means of lugs 65 or the like which prohibit the hand grip 61 from rotating relative to the shank 41 when torque is applied thereto. This allows a user to manually rotate the extension drive 5 and any associated fitting even when the user's hand is slick.

It is anticipated that the hand grip 61 could be formed of a suitable plastic material which could be heated and forced over either the first end 37 or the second end 39 of the drive extension 5 and placed around the drive extension shank 41 adjacent the lugs 65 or, that plastic or the like could be molded about the shank. Thereafter, upon cooling and contracting, the hand grip would snugly and interferingly engage the lugs 65.

The drill adapter 7 includes a first end 67 and a second end 69 and a shank portion 68. The first end 67 includes a fourth socket drive member which comprises a male socket drive mechanism 71 similar to the drive extension male socket drive 43. The male socket drive mechanism 71 includes shoulder surfaces 73 and an end portion 75 which surfaces and end portion are substantially square as before. A detente ball 77 is positioned in one of the surfaces 73 similarly to detente ball 49. The drill adapter second end 69 comprises an elongate cylindrical member 79 which functions as a male drill connection and which is adapted to be received within a chuck 81 of rotary drill 9. The drill adapter shank portion is an elongate cylindrical member and preferably has a knurled surface 70 to facilitate manual manipulation of the drill adapter.

The drill adapter 7 can be used to incorporate the advantages of an electric drill with a socket wrench set. The speed of removing and replacing fastening devices such as nuts and bolts can be increased by use of an electric drill with such a drill adapter 7. Further, the drill adapter 7 can allow the electric drill 9 to function somewhat as an impact wrench and therefore allow an owner of such a drill 83 acquire the advantages of an impact wrench without necessitating the expenditure of a large amount of money.

It is noted that various portions of the kit such as the easy-out 3, or other accessories such as various sockets or associated socket engaging devices such as U-joints can be mated with the drill adapter 7. Further, the easy-out 3 can be mated for use with the drive extension 5 or an associated socket or ratchet wrench 90 with no extension incorporated.

The grippable extension 5 can also be used with associated sockets and socket accessories such that the extension 5 can be manipulated and rotated by hand which at times is easier and faster than attempting to rotate such an extension by an associated ratchet wrench or the like in cramped areas.

In FIG. 1 the tool kit 1 is shown being used to remove a fastener shown as a portion of bolt 12 from an associated object 13. In removing the bolt 12 from the associated object 13, the easy-out first end 23 is positioned into the bore 27 which has previously been drilled into the bolt 12 which bore 27 is smaller than the diameter of the bolt 12 and generally coaxial therewith. The threads of the easy-out which progress the easy-out inwardly into the bolt 12 are pitched in the direction of rotation which removes the bolt 12 from the associated object 13. For example, most bolts have threads which open clockwise rotation of the bolt progress the bolt into an object. Therefore, the easy-out should have threads such that, upon counterclockwise rotation, the easy-out 3 is progressed into the bolt 12 while placing an opposite torque on the bolt 12 so as to urge same from the aperture holding same in the object 13.

The easy-out 3 is preferably made of a material which is harder than the bolt 12 such that upon rotation of the easy-out 3 the threads 25 thereon will cut into the bolt 12 thereby progressing the easy-out into the bolt 12. When the easy-out 3 has been rotated sufficiently such that the easy-out shank 24 snugly and interferingly contacts the bolt bore 27, any further rotation of the easy-out in the same direction will tend to rotate the bolt 12 in a direction so as to remove it from the object 13.

It is noted that after the bolt 12 has begun to rotate the user of the tool kit 1 could remove the drill 9 and drill adapter 7 from engagement with the grippable extension 5 and manually turn the easy-out 3 by using the grippable extension 5.

Further, it is foreseen that if the torque required to initiate the rotation of bolt 12 is high, a means designed to increase torque, such as a socket wrench 90 as shown in FIG. 8, could be used. The socket wrench 90 includes a first end 92, a second end 94 and a shank 96 extending therebetween. At the wrench first end 92 is a socket drive member shown here as a male socket drive mechanism 98 which is similar to male socket drive mechanisms 43 and 71. The socket wrench male mechanism 98 is mateable with the grippable extension female mechanism 53. At the socket wrench second end 90 is a socket drive member such as female socket mechanism 100 which is similar to female socket mechanisms 31 and 53. As shown in FIG. 8, the wrench 90 is mated with the grippable extension 5 such that the male socket drive mechanism 98 of the socket wrench 90 is received into the grippable extension female drive mechanism 53.

In order to apply greater torque the socket wrench 90 could be used in connection with the drill adapter 7 with the drill adapter male socket drive mechanism 71 being received in the socket wrench female mechanism 100.

It is to be understood that while certain embodiments of the present invention have been illustrated and described herein, it is not to be limited to the specific forms or arrangement of parts described and shown.

What is claimed and desired to secure by Letters Patent is as follows:

1. An auxiliary tool kit for a socket wrench set adapted to facilitate removal of a threaded fastener from an associated object having a previously formed aperture coaxial with the threads thereof; said kit comprising:

(a) an easy-out having a first end and a second end, said first end being threaded such as to be reverse threaded relative to said threaded fastener and adapted to be snugly received in the threaded fastener aperture; said second end having a socket drive first member adapted to be mated with an associated socket drive second member;

(b) a grippable extension having a first end, a second end, and a shank intermediate said first and said second end; said first end having said socket drive second member projecting axially outwardly therefrom; said extension second end having a third socket drive member therein adapted to be mated with a fourth socket drive member; said shank having a hand grip positioned therearound near said second end; said hand grip being fixedly positioned on said shank such as to prohibit rotational movement about a longitudinal axis thereof relative to said shank; and (c) a drill adapter having a first end, a second end and a shank; said first end having said fourth socket member projecting outwardly therefrom; said second end having an elongate cylindrical member extending axially outward therefrom; said cylindrical member adapted to be operably received within a chuck of a reversible rotary drill, whereby said easy out can be operably rotated by said rotary drill.

2. In combination with a rotary drill having a reversible drive mechanism, an auxiliary tool kit for a socket wrench set adapted to facilitate removal of a threaded fastener, having a generally axial aperture previously formed therein, from an associated object; said kit comprising:

(a) an easy-out having a first end and a second end, said first end being threaded such as to be reverse threaded relative to said threaded fastener and adapted to be snugly received in the threaded fastener aperture, said second end having a socket drive first member adapted to be mated with an associated socket drive second member;

(b) a grippable extension having a first end, a second end, and a shank intermediate said first and said second end; said first end having said socket drive second member projecting axially outwardly therefrom; said extension second end having a third socket drive member thereon adapted to be mated with a fourth socket drive member; said shank having a hand grip positioned therearound near said second end; said hand grip being fixedly positioned on said shank so as to prohibit rotational movement about a longitudinal axis thereof relative to said shank; and (c) a drill adapter having a first end, a second end and a shank; said first end having said fourth socket drive member projecting axially outward therefrom; said second end having an elongate cylindrical member extending axially outward therefrom; said cylindrical member adapted to be operably received within a chuck of said rotary drill wherein said easy out can be operably rotated by said rotary drill.

3. A tool kit as set forth in claims 1 or 2 wherein:

(a) said socket drive first, and third members comprise an inwardly projecting female socket drive mechanisms;

(b) said socket drive second and fourth members comprise outwardly projecting male socket drive mechanisms; and wherein (c) said first and third socket drive members are each selectively matable with said second and fourth socket drive members.

4. A tool kit as set forth in claim 1 wherein:

(a) said hand grip includes ridge portions of radius greater than said shank fixedly secured to said shank.

5. A tool kit as set forth in claim 1 wherein:

(a) said easy-out is matable with said drill adapter.

6. In combination with a ratchet wrench having a socket drive member attached thereto at a first end thereof and an elongate handle near a second end thereof, an auxiliary tool kit adapted to facilitate removal of a threaded fastener from an associated object comprising:

(a) an easy-out having a first end and a second end, said first end being threaded such as to be reverse threaded relative to said threaded fastener, said second end having a socket drive first member adapted to be mated with an associated socket drive second member;

(b) a first grippable extension having a first end, a second end, and a shank intermediate said first and said second end; said first end having said socket drive second member projecting axially outward therefrom; said extension second end having a third socket drive member thereon adapted to be mated with said ratchet wrench socket drive mechanism; said shank having a hand grip positioned therearound near said second end, wherein said hand grip is fixedly positioned on said shank such as to prohibit rotational movement about a longitudinal axis thereof relative to said shank; said hand grip having a radius substantially greater than said shank so as to provide leverage in manual rotation of said shank;

(c) a fourth socket drive member positioned on said ratchet wrench second end portion; and (d) a second extension having a first end, a second, and an elongate shank therebetween, said first end including a fifth socket drive member extending axially therefrom and adapted to be mated with said fourth socket drive member; said second extension connected to said ratchet wrench whereby additional torque is applied to said easy-out upon the rotation thereof by said ratchet wrench.

7. A tool kit as set out in claim 6 wherein:

(a) said fifth socket drive member is a female socket drive member; and (b) said sixth socket drive member is a male socket drive mechanism.

* * * * *